US005727650A

United States Patent [19]

Thomas

[11] Patent Number: 5,727,650

[45] Date of Patent: Mar. 17, 1998

[54] SUPPORT FRAMEWORK FOR A SCAFFOLD SYSTEM

[76] Inventor: Randy Thomas, P.O. Box 189, Darby, Mont. 59829

[21] Appl. No.: 576,373

[22] Filed: Dec. 21, 1995

[51] Int. Cl.[6] ..... E04G 1/32

[52] U.S. Cl. ..... 182/224; 182/82; 182/117

[58] Field of Search ..... 182/82, 117, 224

[56] References Cited

U.S. PATENT DOCUMENTS

| | | | |
|---|---|---|---|
| 860,161 | 7/1907 | Thomas | 182/185 |
| 1,114,336 | 10/1914 | Blomqvist | 182/224 |
| 1,597,555 | 8/1926 | Tolmie | 182/224 |
| 2,272,957 | 2/1942 | Walp | 182/227 X |
| 2,496,526 | 2/1950 | Falcone | 182/224 |
| 2,549,212 | 4/1951 | J. M. Lane | 182/82 X |
| 2,636,785 | 4/1953 | Albrecht et al. | 182/224 |
| 2,705,174 | 3/1955 | Squire | 1882/185 |
| 2,753,222 | 7/1956 | Foresta et al. | 182/224 |
| 2,883,241 | 4/1959 | Adolfson et al. | 182/82 X |
| 2,966,957 | 1/1961 | Ireland | 182/224 |
| 3,175,642 | 3/1965 | Neeley | 182/224 |
| 4,823,913 | 4/1989 | Riegel, Jr. | 182/227 X |
| 4,877,109 | 10/1989 | Welch et al. | 182/183 |

FOREIGN PATENT DOCUMENTS

| | | | |
|---|---|---|---|
| 471724 | 7/1951 | Canada | 182/185 |

*Primary Examiner*—Alvin C. Chin-Shue
*Assistant Examiner*—Long Dinh Phan
*Attorney, Agent, or Firm*—Harry M. Cross, Jr.

[57] ABSTRACT

A scaffold support comprises a beam fabricated in the form of a rectangular steel tube having width less than its height, and a pair of legs each fabricated in the form of a rectangular steel tube. The legs are welded to opposite sides of the beam so as to diverge from one another at an acute angel and so as to angle outward and downward from the beam at an acute angle from the vertical when the beam is oriented horizontally. An angle bar welded to each leg and extending between the legs to stabilize the legs and to provide a step. A steel scaffolding retainer welded to an outer end of the beam and extended above a top edge of said the so as to prevent scaffolding from moving beyond the outer end, and a steel mounting plate is welded to an inner end of the beam so as to provide a bearing surface for the inner end. Lumber leg extensions may be inserted into the legs to provide an elevated scaffolding support surface, and the lumber leg extensions may be fitted with cross members to provide a ladder, with the last step of the ladder being provided by the angle bar.

3 Claims, 2 Drawing Sheets

FIG. 1
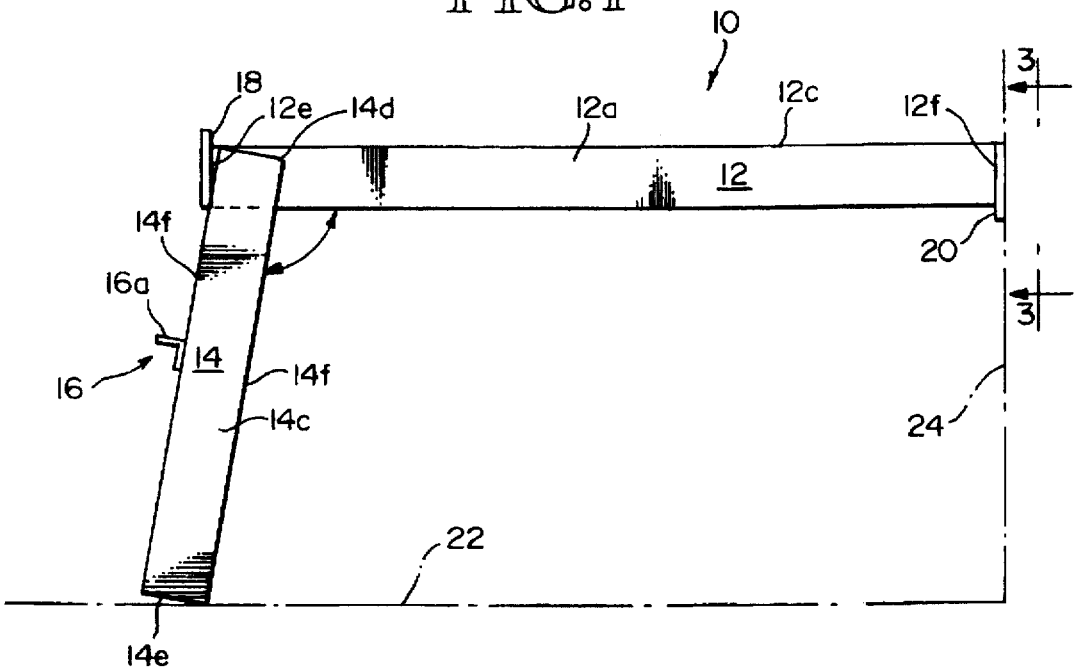
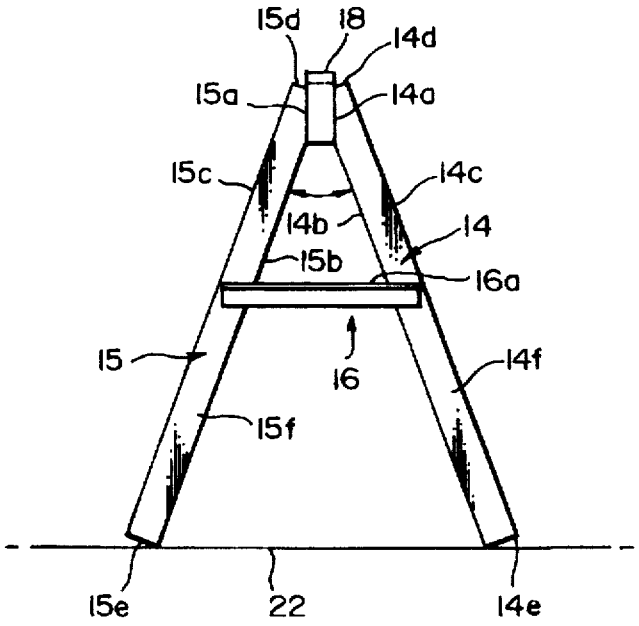
FIG. 2
FIG. 3
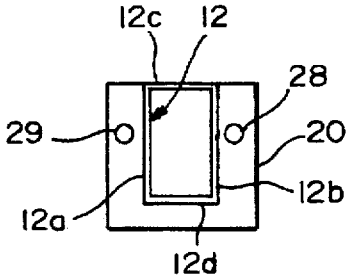

SUPPORT FRAMEWORK FOR A SCAFFOLD SYSTEM

BACKGROUND OF THE INVENTION

1. Field of the Invention

This invention relates to scaffolds and, more particularly, to portable scaffolds used in the construction industry.

2. Brief Description of the Prior Art

Portable scaffolds used in the construction industry during framing, roofing and siding installation, by way of example, are usually inconvenient to install and to move from one location to another. Those systems that can support the weight of carpenters and material are also often too expensive to purchase for may carpenters and, consequently, are available through construction equipment rental shops. Some scaffold systems that have been proposed for portable use are too unstable to use in situations requiring an elevated scaffold platform or in situations where the ground level is uneven or sloped.

SUMMARY OF THE INVENTION

A primary object of this invention is to provide a scaffold support that is solid and stable. Another object is to provide a scaffold support that is already set up and can be used without assembling different parts and pieces. A further object of this invention is to provide a scaffold support that can be safely used to support an elevated scaffold platform. Still another object is to provide a scaffold support that can be used on ground that is uneven or sloped. These and other objects and advantages of this invention will become apparent from the following description of the preferred embodiment.

In accordance with these objects, a scaffold support comprises a beam fabricated in the form of a rectangular steel tube having width less than its height, and a pair of legs each fabricated in the form of a rectangular steel tube. The legs are welded to opposite sides of the beam so as to diverge from one another at an acute angle and so as to angle outward and downward from the beam at an acute angle from the vertical when the beam is oriented horizontally. An angle bar is welded to each leg and extending between the legs to stabilize the legs and to provide a step. A steel scaffolding retainer is welded to an outer end of the beam and extended above a top edge of said the so as to prevent scaffolding from moving beyond the outer end, and a steel mounting plate is welded to an inner end of the beam so as to provide a bearing surface for the inner end. Lumber leg extensions may be inserted into the legs to provide an elevated scaffolding support surface, and the lumber leg extensions may be fitted with cross members to provide a ladder, with the last step of the ladder being provided by the angle bar. The scaffold support beam has an interior with a cross section having a width and height sufficient to accommodate a nominal 2×4 inch lumber member with minimal clearance between the lumber member and the beam interior. Each leg has an interior with a cross section having a width and height sufficient to accommodate a nominal 2×4 inch lumber member with minimal clearance between the lumber member and the leg interior. Each leg is welded to one of the beam sides so that a wider side of each leg faces the opposite leg.

BRIEF DESCRIPTION OF THE DRAWINGS

FIG. 1 is a side elevation view of the scaffold support of this invention;

FIG. 2 is an end elevation view of the FIG. 1 scaffold support;

FIG. 3 is a detail view taken from the location indicated as 3—3 in FIG. 1;

DESCRIPTION OF THE PREFERRED EMBODIMENT

Figure 4:
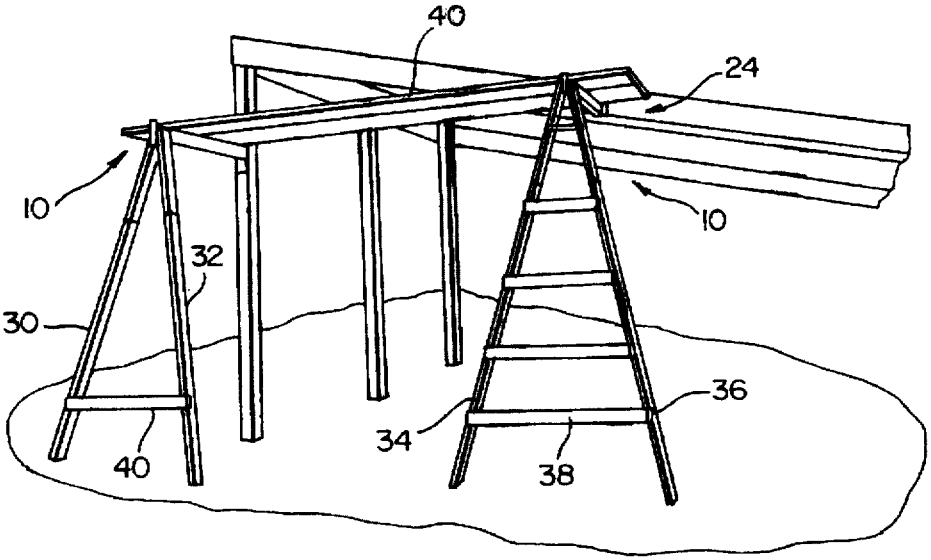
FIG. 4 is a front perspective view of a construction location illustrating a scaffold system employing two of the FIG. 1 scaffold supports to support an elevated scaffold platform from uneven and sloped ground.

The scaffold support 10 of this invention comprises a horizontal beam 12, two legs 14 and 15, a combination stabilizing bar and step 16, a scaffolding retainer 18, and a combination bearing and mounting plate 20. Elements 12, 14, 15, 16, 18 and 20 are fabricated of steel and welded to one another in the configuration show in FIGS. 1–3. Beam 12 is a hollow steel tube having a rectangular cross section sized to contain a 2×4 inch lumber extension member (not shown) on edge. Legs 14 and 15 are identical hollow steel tubes, each having a rectangular cross section sized to a contain 2×4 inch lumber extension, with their inner wider sides facing one another.

The narrow edges **14*f* and 15*f* of the steel tubes for legs 14 and 15 are cut in a taper at their upper ends as shown in FIG. 2 at 14*a* and 15*a* and the inside wider faces 14*b*, 15*b* of these steel tubes are cut shorter than the outside wider faces 14*c*, 15*c* to accommodate the tapered upper edges 14*a*, 15*a*. The tops 14*d* and 15*d* and bottoms 14*e* and 15*e* are cut off square so that they are perpendicular to the narrow edges and wider faces of the steel tubes. The narrow edges 14*f* and 15*f* of the steel tubes are welded to the wider faces 12*a* and 12*b* of the beam 12 along the tapers at 14*a* and 15*a* to permanently attach the legs 14 and 15 to the beam 12**.

The tapers at **14*a* and 15*a* are cut so that the legs diverge from one another to provide an included angle of 40°, + or − about 10%. The legs 14 and 15 are welded to the outer end of beam 12 as shown so that they are angled outward and downward at 20° from the vertical, + or − about 10%; 20° from the vertical being the same as the 110° angle shown in FIG. 1 with respect to the horizontal beam 12. Stabilizing steel bar 16 is a 2 inch an angle bar that is welded to the narrow outer edges 14*f* and 15*f* of legs 14 and 15 as shown, about midway between the top and bottom ends of the legs, and the top part 16*a* of the angle bar 16 extends outward perpendicular to the outer narrow edges 14*f*, 15*f*** of the legs to provide a step.

Beam 12 is preferably about 4 feet long and legs 14, 15 are preferably about 32 inches long, the leg orientation and placement with respect to beam 12 being such that the height of the support 10 from the ground line 22 to the top edge **12*c* is also about 32 inches. The leg top ends 14*d* and 15*d* do not extend above the top edge 12*c* of the beam. Stabilizing bar and step 16 is located between 14–16 inches from the top edge 12*c*** of the beam.

Scaffolding retainer 18 is a rectangular steel plate having a width sufficient to cover the end of beam 12 and a length sufficient to extend from the bottom edge **12*d* of the beam to an elevation about 1-½ inches above the top edge 12*c* of the beam. It is welded to the front end 12*e* of the beam as shown in FIGS. 1 and 2. The retainer 18** extends far enough above the beam to retain standard 1-½ inch scaffolding.

Figure 5:
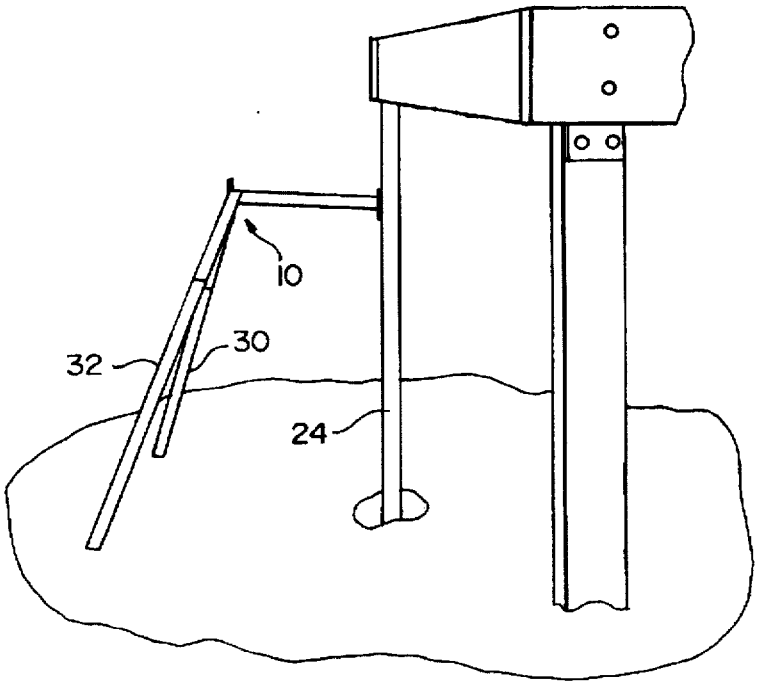
FIG. 5 is side perspective view of a construction location illustrating the set up of one FIG. 1 scaffold support against a post.

The bearing and mounting plate 20 is welded to the rear end **12*f* of the beam as shown in FIGS. 1 and 3. It is formed in a rectangular U-shape so as to encompass the sides and bottom of the beam and to be welded thereto. Alternately, the plate 20 can be sized to fit over the end walls of the beam at the rear end 12***f* so as to cover the tube edges, while still leaving the tube interior clear, and welded to the tube sides and bottom. The plate 20 extends from the top edge 12*c* of the beam to an elevation a little bit below the bottom edge 12*d* and serves as a bearing member that can rest against a wall or a post. In the absence of plate 20, the wall edges of the beam 12 might cut into the surface 24 against which it is set. So plate 20 increases the bearing surface area of the support, making it more stable and less likely to damage the surface 24 against which it is set. The sides of plate 20 may be provided with one or more holes 28, 29 so that the support could be nailed to the surface 24 against which it is set. This would be especially desirable if surface 24 were a post. FIG. 5 illustrates the location of the support 10 against a post for support. One can imagine that the support 10 might possibly be jarred away from the post when men and materials are on a scaffolding platform supported by the beam. The provision of plate 20 is an important element; the provision of nailing holes 28, 29 permitting the support 10 to be securely attached to the relatively narrow width of the post so that the beam could not accidentally be dislodged from surface 24 and fall away.

FIG. 4 illustrates the application of two supports 10 to a construction site where the left-hand support bears against a vertical post and the right-hand support bears against a roof beam. FIG. 4 also illustrates that 2×4 inch lumber leg extensions 30, 32 and 34, 36 can be inserted into the tubes of legs 14, 15 of each support to elevate the supports to the elevation required by the particular construction site. In the case of the left-hand support 10, it is seen that the ground is not only uneven but also slopes. A feature of this invention is that the 2×4 inch lumber leg extensions can be cut to the required length to accommodate variations in the terrain from which the supports 10 are to be extended. Because the legs 14, 15 have a substantial length, preferably being about 32 inches long, the lumber leg extensions are adequately contained therein so that the extensions need not be nailed or otherwise secured in the legs 14 and 15. When lumber leg extensions are inserted into the tubes of legs 14 and 15, as shown in FIGS. 4 and 5, they are inserted up into the legs as far as they will go, until they contact the portions of the beam sides 12*a*, 12*b* that are exposed to the interior of the leg tubes.

It is an important feature of the support 10 that legs 14 and 15 are long enough to provide an approximately waist-high working surface from the ground to the top edge 12*c* of beam 12 when no lumber extensions are employed, as shown in FIGS. 1 and 2. Therefore, the support 12 can provide a working platform height without adding any other element other than a scaffolding platform as a work surface. Moreover, with a working height of about 32 inches, as seen in FIGS. 1 and 2, a worker can stand on a scaffolding platform and easily reach up to an elevation of 8–10 feet. Because of the extended length of the legs 14 and 15, lumber leg extensions, such as extensions 30–36, up to 20 feet can be safely used.

It is another important feature of the support 10 that legs 14 and 15 are oriented so that their wider sides face one another, rather than their narrower edges. When lumber leg extensions are employed, such as shown in FIGS. 4 and 5, the bending force on the lumber extensions is cross-wise to the width of the lumber, and such lumber extensions are stiff enough cross-wise to their nominal 4 inch width where they would not be stiff enough cross-wise to their nominal 2 inch width. Because the legs 14 and 15 extend outward and downward at a small angle of about 20° from the vertical and diverge from another at a relative small angle of about 40°, 2×4 lumber can be safely used for the lumber extensions up to heights of about 20 feet. If the legs 14 and 15 angled outward at a greater slope or diverged at a greater angle, the safety of using 2×4 lumber for the leg extensions would become marginal. Moreover, angling the legs outward more than about 20° from the vertical would make it difficult to use the lumber leg extensions as a ladder because the slope of the ladder would be too flat. Diverging the legs apart more than about 40° would cause lumber leg extensions to be spaced too far apart at their base, even at an elevation of 8 feet, to be accommodated by many work sites.

FIG. 4 also illustrates that the lumber leg extensions of one or both supports 10 may have 2×4 cross members 38 nailed to the extensions to provide a stable ladder up to the scaffolding platform 40. A separate ladder is not required when using the supports of this invention. Only one such ladder arrangement need be provided and the other set of leg extensions may be further stabilized by a 2×4 cross member 42 at the bottom. The last step of the ladder is provided by the steel angle bar that is welded between the two steel support legs.

In some constructions situations, a scaffold platform wider than about 4 feet may be required, or the support surface 24 may be located inward such that the available working space along the length of beam 12 is curtailed. Therefore, beam 12 is hollow so that a 2×4 lumber beam extension can be inserted into beam 12 and extended out through the rear end 12*f*. Such a lumber beam extension (not shown) would extend through the beam 12 and butt against the retainer 18.

Also, in some construction situations, it might be desirable to provide a working surface double the length of beam 12, in which case a second set of supports 10 could be positioned in mirror image to FIG. 1 and a 2×4 lumber extension, at least 8 feet in length, could be extended through and from one support beam into and through the mirror image support beam to provide a length of at least 8 feet—at twice the length of each beam 12. In this configuration, mounting plate 20 and its mirror image could be aligned and bolted together, using the holes 28 and 29, to securely fasten the mounting plates to one another.

While the preferred embodiment of the invention has been described herein, variations in the design may be made. The scope of the invention, therefore, is only to be limited by the claims appended hereto.

The embodiments of the invention in which an exclusive property is claimed are defined as follows:

I claim:

1. A scaffold support which comprises beam means comprising a first rectangular steel tube having width less than its height, a steel mounting plate welded to an inner end of said first steel tube so as to provide a bearing surface for said inner end, and a steel scaffolding retainer welded to an outer end of said first steel tube so as to cover said outer end and extend above a top edge of said first steel tube; leg means supporting said beam means at a working level of about waist height comprising hollow second and third rectangular steel tubes, the second and third steel tubes being welded to opposite sides of said first steel tube so as to diverge from one another at an acute angle of about 40° and so as to angle outward and downward from said first steel tube at an acute angle of about 20° from the vertical when said first steel tube is oriented horizontally, corresponding to an angle about 110° from said first steel tube, and an angle bar welded to said second and third steel tubes and extending between the second and third steel tubes to stabilize them and to provide a step; the second and third steel tubes of said leg means being so constructed and arranged that said beam means can be supported horizontally against an object contacting said bearing surface as a consequence of the second and third steel tubes of said leg means extending outward and downward beyond the outer end of said first steel tube.

2. The scaffold support of claim 1 wherein said second and third steel tubes have a length of about 32 inches, and said first steel tube has a length of about 4 feet.

3. The scaffold support of claim 1 wherein said first steel tube has an interior with a cross section having a width and height sufficient to accommodate a nominal 2×4 inch lumber member with minimal clearance between the lumber member and the tube interior; and wherein said second and third steel tubes each have an interior with a cross section having a width and height sufficient to accommodate a nominal 2×4 inch lumber member with minimal clearance between the lumber member and the tube interior; and wherein said second and third steel tubes are welded to opposite sides of said first steel tube so that wider sides of said second and third steel tubes face one another.

* * * * *